US005517163A

United States Patent [19]

Sagawa et al.

[11] Patent Number: 5,517,163

[45] Date of Patent: May 14, 1996

[54] DIELECTRIC COAXIAL RESONATOR

[75] Inventors: Morikazu Sagawa, Tokyo; Mitsuo Makimoto, Yokohama, both of Japan

[73] Assignee: Matsushita Electric Industrial Co., Ltd., Osaka, Japan

[21] Appl. No.: 362,295

[22] Filed: Dec. 22, 1994

[30] Foreign Application Priority Data

Dec. 24, 1993 [JP] Japan ..... 5-328244

[51] Int. Cl.[6] ..... H01P 7/04

[52] U.S. Cl. ..... 333/222; 333/206

[58] Field of Search ..... 333/202, 206, 333/207, 219.1, 222, 223

[56] References Cited

U.S. PATENT DOCUMENTS

| | | | |
|---|---|---|---|
| 4,506,241 | 3/1985 | Makimoto et al. | 333/206 X |
| 4,985,690 | 1/1991 | Eauchi et al. | 333/222 |
| 5,109,207 | 4/1992 | Aizawa et al. | 333/222 |

FOREIGN PATENT DOCUMENTS

| | | |
|---|---|---|
| 0434296 | 6/1991 | European Pat. Off. . |
| 3-101017 | 10/1991 | Japan . |
| 5-63411 | 3/1993 | Japan . |
| 5-063412 | 3/1993 | Japan . |

*Primary Examiner*—Paul Gensler

*Attorney, Agent, or Firm*—Lowe, Price, LeBlanc & Becker

[57] ABSTRACT

A compact dielectric coaxial resonator is provided which includes a dielectric substance having a preselected length along the center line thereof, a groove formed in an end portion of the dielectric substance, a through hole, formed in the dielectric substance, extending through the center line of the dielectric substance, an outer conductive member provided around the periphery of the dielectric substance, and an inner conductive member provided over the groove and the through hole. The groove is exposed to the outside and defined around the center line of the dielectric substance. The through hole is defined to have a given length shorter than the preselected length of the dielectric substance for achieving a small-sized structure with a high unloaded Q which may be manufactured in a simple manner.

25 Claims, 7 Drawing Sheets

DIELECTRIC COAXIAL RESONATOR

BACKGROUND OF THE INVENTION

1. Technical Field of the Invention

The present invention relates generally to a dielectric coaxial resonator which may be employed in a wide variety of radio communication devices, and more particularly to an improved structure which produces a dielectric coaxial resonator of very small physical size with a high unloaded Q.

2. Background Art

In recent years, there is an increasing need for compact and lightweight equipment in the field of radio communication such as portable telephones. In filter devices commonly built in present day portable radio communication devices, coaxial resonators using dielectric materials assuring a high dielectric constant with low loss, are widely utilized. The reduction in size for such coaxial resonators is usually accomplished by using dielectric materials having a high dielectric constant or modifying the shape of a resonator body so as to change the characteristic impedance of a line in a stepwise fashion.

FIGS. 7(*a*) and 7(*b*) show a conventional dielectric coaxial resonator. FIG. 7(*a*) illustrates a vertical cross section of the coaxial resonator taken along the center line thereof. FIG. 7(*b*) is a side view.

The shown coaxial resonator generally includes a hollow dielectric substance 1 having formed therein a through hole 2, a ring portion 3, a central conductive film 4 continuing from the ring portion 3 to the through hole 2, and an outer conductive film 5 to produce a structure wherein one end is opened and the other is short-circuited.

The dielectric coaxial resonator thus constructed provides an increased inductance component of the central conductive film as well as increased capacitive components between the ring portion 3 and the through hole 2 and between the through hole 2 and the outer conductive film 5, thereby allowing the overall size to be reduced.

The above prior art resonator, however, has the drawback in that shortening the full length of the resonator requires the formation of a plurality of ring portions in the opening end portion or the increase in depth of the ring portion, thereby resulting in an increased area of the central conductive film exposed to the outside as well as complex machining processes. This causes electric field components around the opening end portion of the resonator to spread out of the outer conductive film 5, leading to the reduction in unloaded Q.

Additionally, the adjustment of the resonance frequency is conventionally accomplished by machining the outer conductive film. It is, however, difficult to adjust the resonance frequency while maintaining the axially symmetrical structure as is, leading to the uneven distribution of electromagnetic field, which will cause the unloaded Q to be reduced.

SUMMARY OF THE INVENTION

It is therefore a principal object of the present invention to avoid the disadvantages of the prior art.

It is another object of the present invention to provide a compact dielectric coaxial resonator with a high unloaded Q which can be manufactured in a simple manner.

According to one aspect of the present invention, there is provided a dielectric coaxial resonator which comprises a dielectric substance having a preselected length along the center line thereof, a groove formed in an end portion of the dielectric substance so as to be exposed to the outside, the groove being defined around the center line of the dielectric substance, a through hole, formed in the dielectric substance, extending through the center line of the dielectric substance, the through hole having a given length shorter than the preselected length of the dielectric substance, an outer conductive member provided around a periphery of the dielectric substance, and an inner conductive member provided over the groove and the through hole.

In the preferred mode of the invention, the outer conductive member is isolated from the inner conductive member at the end portion having formed therein the groove, while being connected to the inner conductive member at an opposite end portion of the dielectric substance.

A second groove is further formed in an end portion of the dielectric substance opposite the end portion in which the groove is formed. The second groove is exposed to the outside and extends around the center line of the dielectric substance. The inner conductive member extends over the second groove so as to isolate the second groove from the outer conductive member.

The groove is defined by a radially outward wall and a radially inward wall both extending parallel to the periphery of the dielectric substance.

The groove may alternatively be defined by a tapered wall. The tapered wall is so oriented as to narrow the width of the groove in a depth direction.

The radially inward wall may be so oriented at a given angle to the center line of the dielectric substance as to form a frusto-conical portion around an end portion of the through hole. Additionally, the radially inward wall may alternatively be so oriented at a preselected angle to the center line as to define a frustum of pyramid at a portion of the dielectric substance around the end portion of the through hole.

According to another aspect of the present invention, there is provided a dielectric coaxial resonator which comprises a dielectric substance having first and second end portions traversing the center line thereof, a groove formed in the first end portion of the dielectric substance coaxially with the dielectric substance to define a double walled portion, a through hole, formed in the dielectric substance, extending through the center line of the dielectric substance, an outer conductive member provided around a periphery of the dielectric substance, and an inner conductive member provided over the groove and the through hole.

BRIEF DESCRIPTION OF THE DRAWINGS

The present invention will be understood more fully from the detailed description given hereinbelow and from the accompanying drawings of the preferred embodiment of the invention, which, however, should not be taken to limit the invention to the specific embodiment but are for the purpose of explanation and understanding only.

In the drawings:

FIG. 1(*b*) is a side view which illustrates an opening end of the resonator shown in FIG. 1(*a*);

FIG. 2(*b*) is a side view which illustrates an opening end of the resonator shown in FIG. 2(*a*);

FIG. 3(*b*) is a side view which illustrates an opening end of the resonator shown in FIG. 3(*a*);

FIG. 4(*b*) is a side view which illustrates an opening end of the resonator shown in FIG. 4(*a*);

FIG. 5(*b*) is a side view which illustrates an opening end of the resonator shown in FIG. 5(*a*);

FIG. 6(*b*) is a side view which illustrates an opening end of the resonator shown in FIG. 6(*a*);

FIG. 7(*b*) is a traverse cross sectional view of the dielectric coaxial resonator shown in FIG. 7(*a*).

DESCRIPTION OF THE PREFERRED EMBODIMENT

Figure 1A:
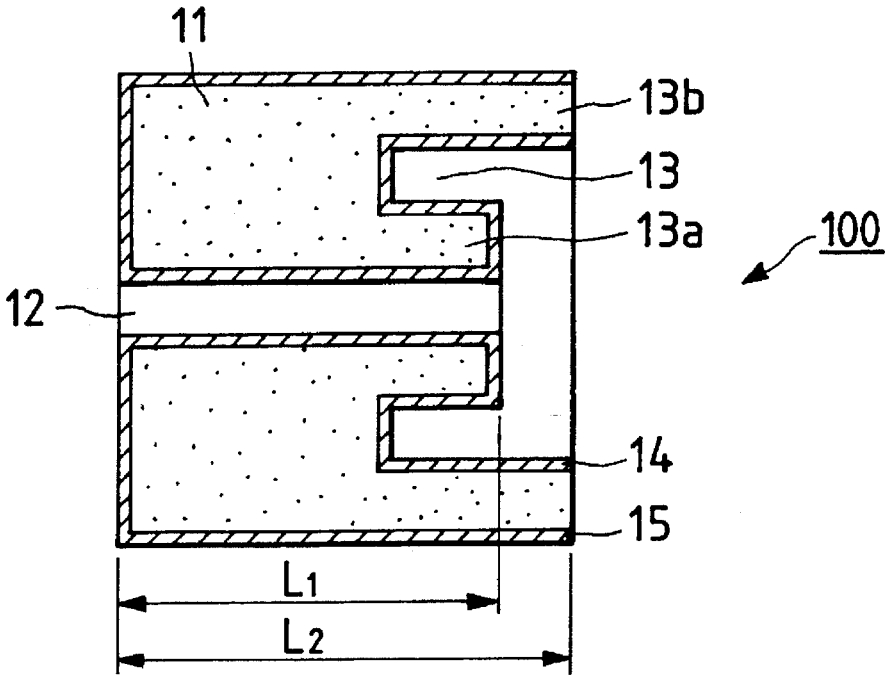
FIG. 1(*a*) is a vertical cross sectional view which shows a dielectric coaxial resonator according to the present invention.
Figure 1B:
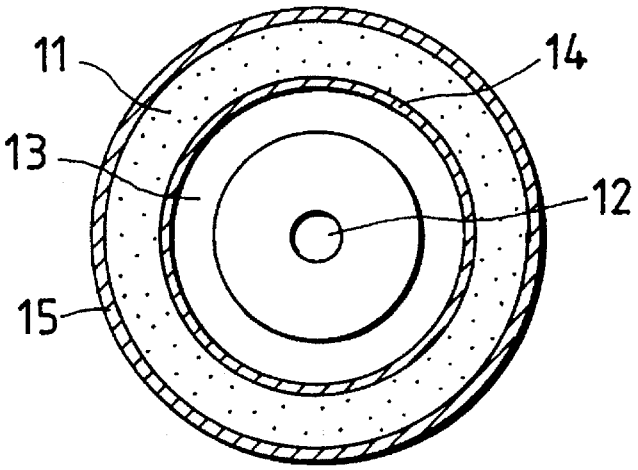

Referring now to the drawings, wherein like numbers refer to like parts in several views, particularly to FIGS. 1(*a*) and 1(*b*), there is shown a dielectric coaxial resonator 100 according to the present invention. FIG. 1(*a*)illustrates a vertical cross section taken along the central line of the resonator 100 thereof. FIG. 1(*b*) is a side view of the resonator 100.

The dielectric coaxial resonator 100 generally includes a hollow cylindrical dielectric substance 11, an inner, or central conductive film 14, and an outer conductive film 15. The central conductive film 14 continues from the outer conductive film 15 at an end of the resonator 100 to form a short-circuit end, while it is isolated from the outer conductive film 15 at the opposite end of the resonator 100 to form an open end. In addition, the dielectric substance 11 is geometrically oriented to define an annular groove 13 and a cylindrical through hole 12 which are, as clearly shown in the drawings, arranged coaxially with the dielectric substance 11. The annular groove 13 is exposed to the outside through the open end of the resonator 100, while the through hole 12 so extends from the short-circuit end as to have the length $L_1$ which is shorter than the length $L_2$ of the outer conductive member 15 (i.e., the full length of the dielectric coaxial resonator 100).

The dielectric coaxial resonator 100 thus constructed, as can be seen from the drawings, provides a double walled section defined by a radially inward wall 13*a* and a radially outward wall 13*b* of the groove 13. This structure increases an inductance component as well as a capacitive component of the central conducting member 14, thereby achieving a very small physical size design. Additionally, a higher resonance frequency becomes different from an odd multiple of a fundamental frequency. Therefore, when the resonator 100 is used with an output filter of a non-linear circuit such as a power amplifier, it is possible to effectively suppress harmonics of odd multiples of the fundamental frequency.

The length of the through hole 12, as explained above, is shorter than the full length of the resonator 100, so that a wide opening area is formed at the end of the resonator 100. This structure facilitates easy machining of the groove 13. Additionally, the central conductive film 14 which is arranged inside the outer conductive film 15, serves to prevent the electric field from spreading outside the outer conductive film 15, thereby providing the dielectric coaxial resonator 100 with a high unloaded Q.

Further, the resonance frequency can be adjusted by removing parts of the dielectric substance 11 and the outer conductive film 15 at the open end of the resonator 100 without changing the axially symmetric structure. The distribution of an electric field is, thus, maintained axially symmetric and uniform without reducing an unloaded Q.

The disclosed structure thus provides an arrangement wherein, by virtue of the geometric orientation of the groove around the end portion of the through hole, the dielectric coaxial resonator exhibits a uniform characteristic impedance.

Figure 2A:
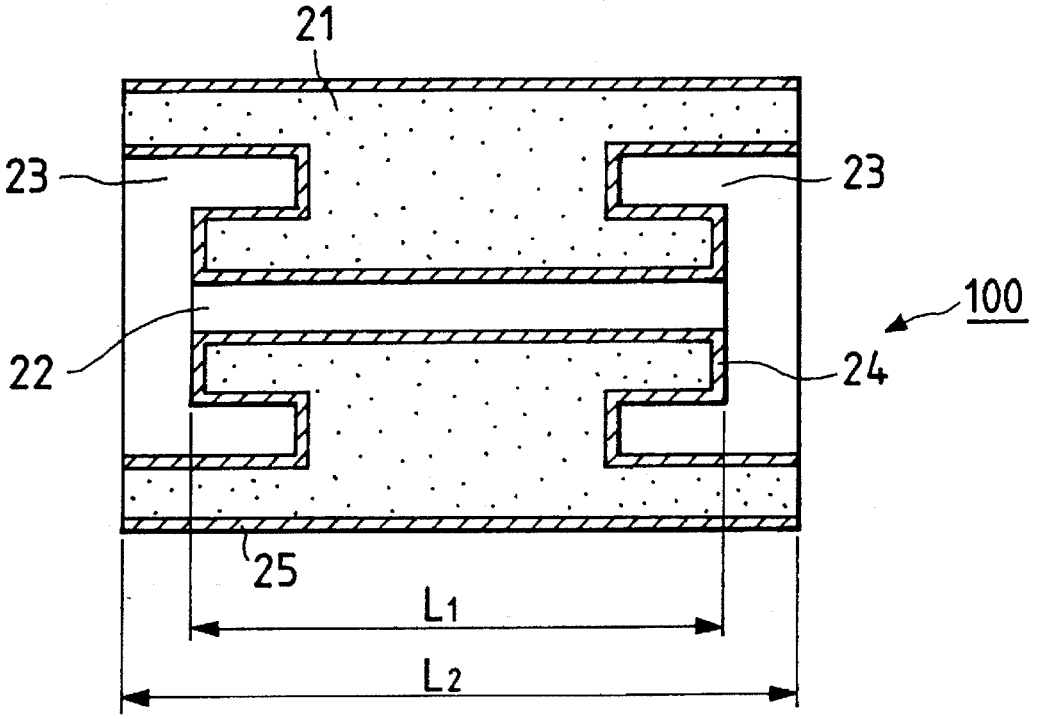
FIG. 2(*a*) is a vertical cross sectional view which shows a dielectric coaxial resonator according to a second embodiment.
Figure 2B:
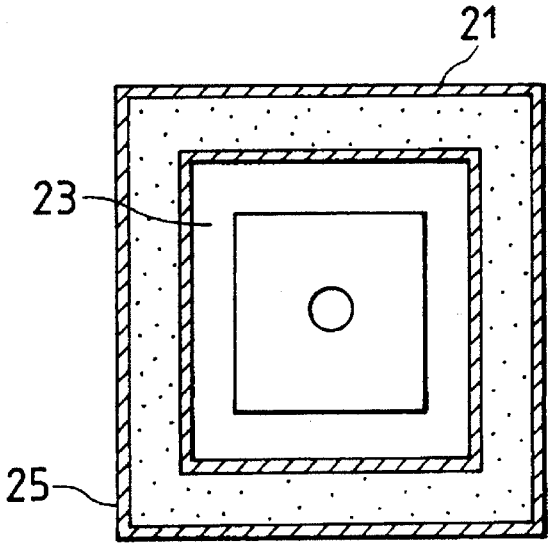

Referring to FIGS. 2(*a*) and 2(*b*), there is shown an alternative embodiment of the dielectric coaxial resonator 100 which is different from the above first embodiment in that a central conductive film 24 is isolated from an outer conductive film 25 at both ends of the resonator 100.

A dielectric substance 21 is, as can be seen in FIG. 2(*b*), substantially square in cross section. A circular through hole 22 is so formed as to extend along the center line of the resonator 100. Square grooves 23 are so formed in both ends of the dielectric substance 21 as to be arranged coaxially with the through hole 22. Each of the grooves 23 is, as clearly shown in FIG. 2(*b*), defined by a radially outward wall and a radially inward wall both extending parallel to the center line of the resonator 100. The radially inward wall is shorter in length than the outer wall so that the length $L_1$ of the through hole 22 may be shorter than the full length $L_2$ of the resonator 100.

The structure of the resonator 100 according to the second embodiment is, as appreciated from the above, different from that of the first embodiment in that the grooves 23 are so formed in both ends of the resonator as to be exposed to the outside and the full length of the resonator is longer, but however, it offers the same advantages as discussed above in the first embodiment. In general, a half-wave resonator having a both end-opened structure with uniform impedance resonates at a frequency of integral times the fundamental frequency, while the resonator 100 of this embodiment may shift higher resonance frequencies from integral multiples of the fundamental frequency since it is possible to have the full length of the resonator 100 shorter than the half wave length.

Further, the dielectric substance 21 in rectangular configuration facilitates positioning and handling when the resonator 100 is mounted on a circuit substrate to assemble a filter.

Figure 3A:
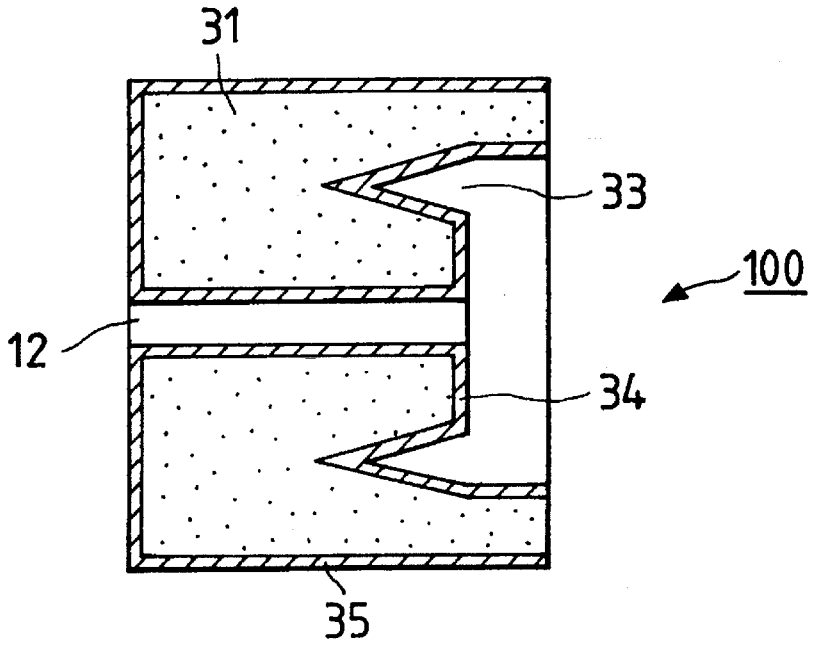
FIG. 3(*a*) is a vertical cross sectional view which shows a dielectric coaxial resonator according to a third embodiment.
Figure 3B:
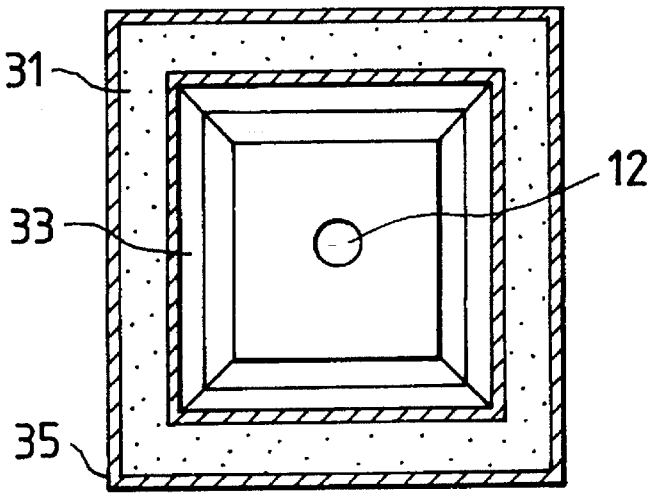

Referring to FIGS. 3(*a*) and 3(*b*), there is shown a third embodiment of the dielectric coaxial resonator 100. FIG. 3(*a*) illustrates a vertical cross section of the resonator 100 taken along the central line thereof. FIG. 3(*b*) is a side view of the resonator 100 shown in FIG. 3(*a*).

The resonator 100 of this embodiment is different from that in the first embodiment shown in FIGS. 1(*a*) and 1(*b*) only in that the overall configuration is rectangular and a groove 33 is of wedge shape. Other arrangements are the same and explanation thereof in detail will be omitted here.

The central conductive film 34 connects with an outer conductive film 35 at an end of the resonator 100. A dielectric substance 31, as can be seen in FIG. 3(*b*), forms the groove 33 so as to produce a square configuration. The groove 33 is, as clearly shown in FIG. 3(*a*), defined by a tapered surface. The tapered shape makes it possible to machine the groove deeper, resulting in an increased length of the double walled section. This achieves a further reduced size for an overall resonator structure with a higher unloaded Q, and also prevents the central conductive film 34 from peeling off the dielectric substance 31, which may occur around corners of the rectangular groove 33.

Figure 4A:
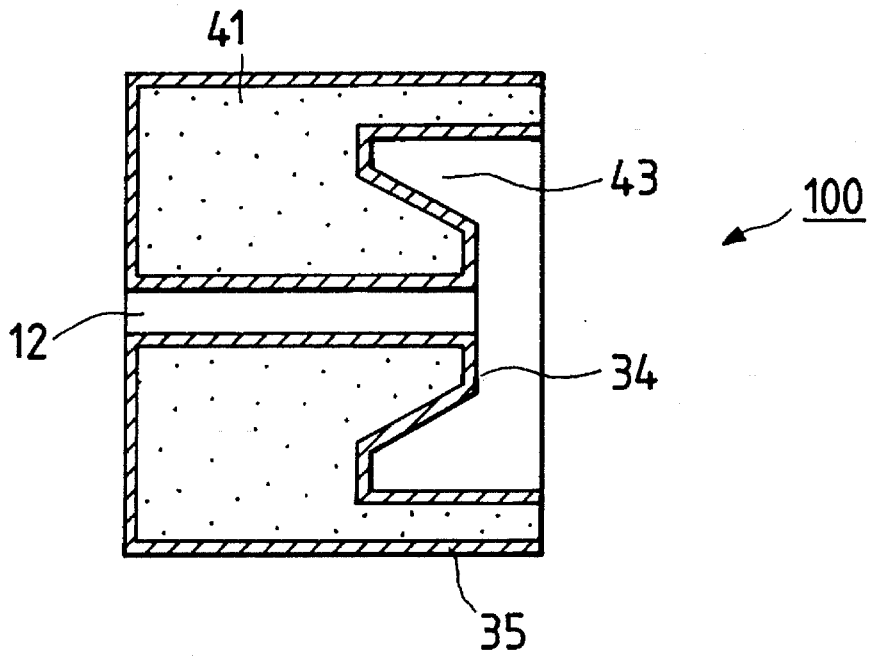
FIG. 4(*a*) is a vertical cross sectional view which shows a dielectric coaxial resonator according to a fourth embodiment.
Figure 4B:
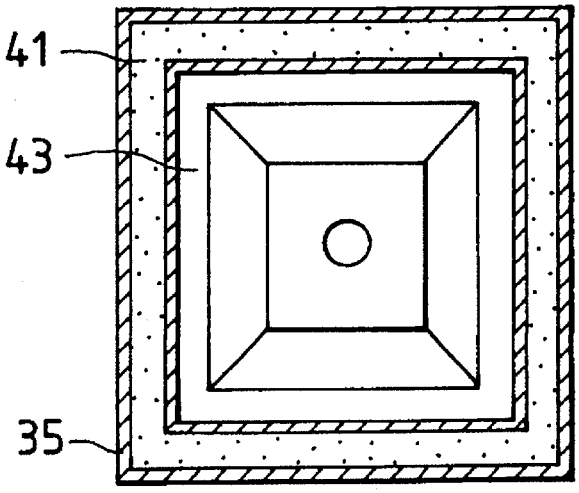

Referring to FIGS. 4(*a*) and 4(*b*), there is shown a fourth embodiment of the dielectric coaxial resonator 100 which is a modification of the one in the third embodiment. FIG. 4(*a*) illustrates a vertical cross section of the resonator 100 taken along the central line thereof. FIG. 4(*b*) is a side view of the resonator 100.

The resonator 100 of this embodiment is different from that of the third embodiment only in configuration of a groove 43. Other arrangements are the same and explanation thereof in detail will be omitted here.

The groove 43 is, as clearly shown in FIG. 4(*a*), defined by a flat bottom wall having a given width, a radially outward wall extending parallel to the outer conductive film 35, and a radially inward wall sloping toward the bottom wall at a given angle to the center line to define the frustum of pyramid at the central end portion. This structure allows the thickness of a dielectric substance 41 between the radially outward wall of the groove 43 and the outer conductive film 35 to be decreased, resulting in an increased capacitive component in this region. This achieves a further reduced size for an overall resonator structure.

Figure 5A:
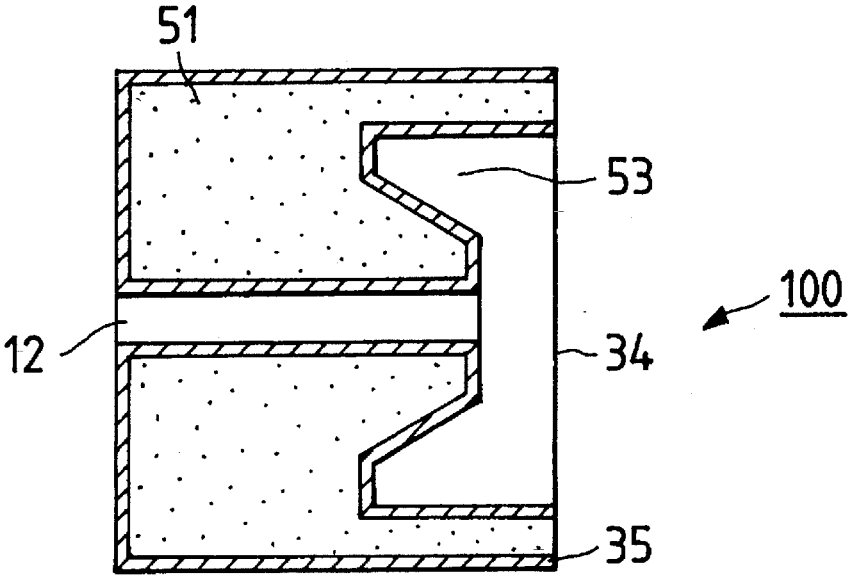
FIG. 5(*a*) is a vertical cross sectional view which shows a dielectric coaxial resonator according to a fifth embodiment.
Figure 5B:
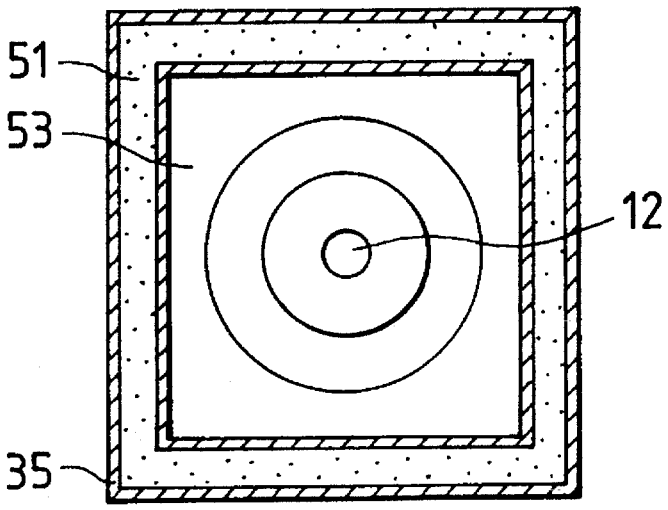

Referring to FIGS. 5(*a*) and 5(*b*), there is shown a fifth embodiment of the dielectric coaxial resonator 100 which is a modification of the one shown in FIGS. 4(*a*) and 4(*b*). FIG. 5(*a*) illustrates a vertical cross section of the resonator 100 taken along the center line thereof. FIG. 5(*b*) is a side view of the resonator 100.

The resonator 100 of this embodiment is different from that of the fourth embodiment only in configuration of a groove 53. Other arrangements are the same and explanation thereof in detail will be omitted here.

A dielectric substance 51 produces a frusto-conical portion in an opening end portion of the resonator 100 to define an annular shape of the groove 53 along with a circular radially outward wall. The annular shape of the groove 53 decreases the number of sharp corners to prevent separation of the central conductive film 34 from the groove 53.

Figure 6A:
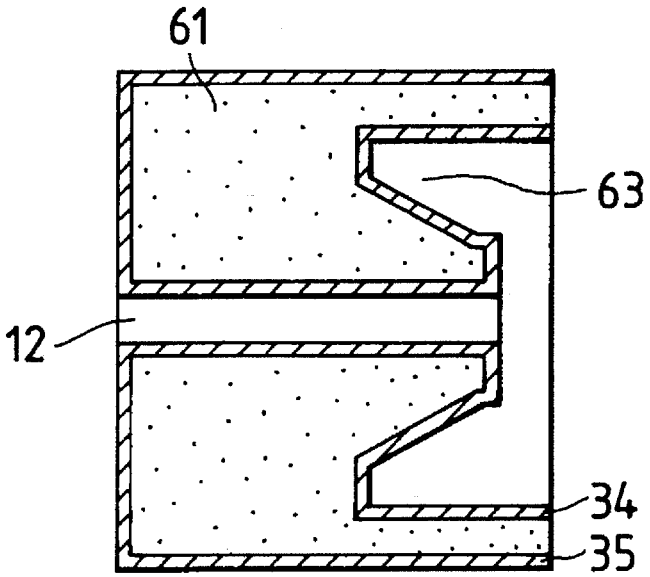
FIG. 6(*a*) is a vertical cross sectional view which shows a dielectric coaxial resonator according to a sixth embodiment.
Figure 6B:
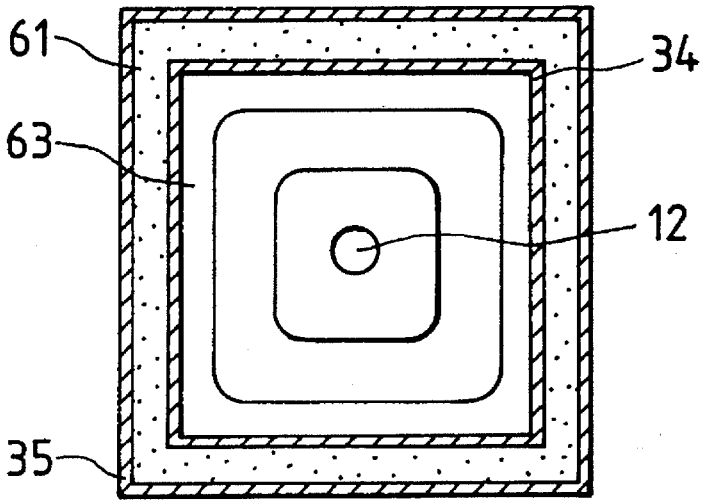
Figure 7A:
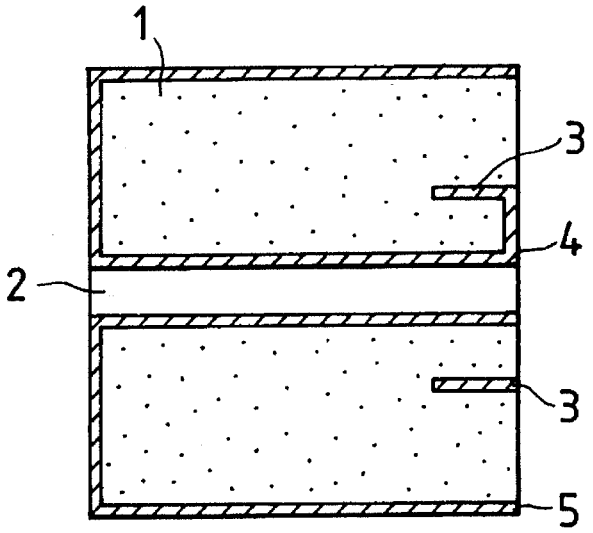
FIG. 7(a) PRIOR ART
FIG. 7(*a*) is a vertical cross sectional view which shows a conventional dielectric coaxial resonator.
Figure 7B:
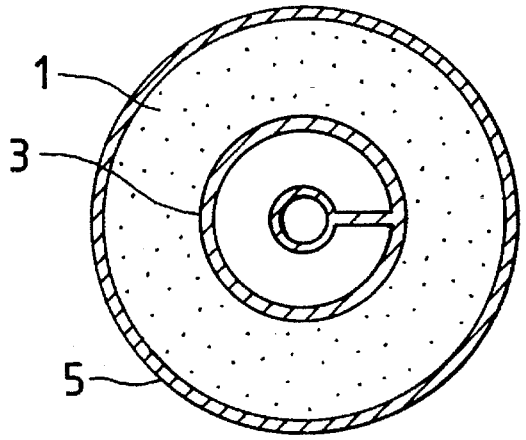
FIG. 7(b) PRIOR ART

Referring to FIGS. 6(*a*) and 6(*b*), there is shown a sixth embodiment of the dielectric coaxial resonator 100 which is a modification of the above fifth embodiment shown in FIGS. 5(*a*) and 5(*b*). FIG. 6(*a*)illustrates a vertical cross section of the resonator 100 taken along the central line thereof. FIG. 6(*b*) is a side view of the resonator 100.

The resonator 100 of this embodiment is different from that of the fourth embodiment shown in FIGS. 4(*a*) and 4(*b*) only in that corners of a groove 63 are rounded. Other arrangements are the same and explanation thereof in detail will be omitted here.

The rounded corners of the groove 63 prevents a portion of a central conductive film 64 attached therearound from being separated from a dielectric substance 61.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

For example, although, in the third to sixth embodiments, the groove is formed only in one end of the resonator, it could be formed in both ends. Further, the outer conductive film may also be rectangular or circular.

What is claimed is:

1. A dielectric coaxial resonator comprising:

a dielectric substance having a preselected length along the center line thereof;

a groove formed in an end portion of said dielectric substance so as to be exposed to the outside, said groove being defined around the center line of said dielectric substance;

a through hole, formed in said dielectric substance, extending through the center line of said dielectric substance, said through hole having a given length shorter than the preselected length of said dielectric substance;

an outer conductive member provided around a periphery of said dielectric substance; and an inner conductive member provided over said groove and said through hole, wherein said outer conductive member is isolated from said inner conductive member at the end portion having formed therein said groove, while being connected to said inner conductive member at an opposite end portion of said dielectric substance.

2. A dielectric coaxial resonator as set forth in claim 1, further comprising a second groove formed in an end portion of said dielectric substance opposite the end portion in which said groove is formed, said second groove being exposed to the outside and extending around the center line of said dielectric substance.

3. A dielectric coaxial resonator as set forth in claim 2, wherein the inner conductive member extends over said second groove, said second groove being isolated from said outer conductive member.

4. A dielectric coaxial resonator as set forth in claim 1, wherein said groove is formed coaxially with said outer conductive member.

5. A dielectric coaxial resonator as set forth in claim 1, wherein said dielectric substance is circular in cross section along the center line thereof.

6. A dielectric coaxial resonator as set forth in claim 1, wherein said dielectric substance is square in cross section along the center line thereof.

7. A dielectric coaxial resonator as set forth in claim 1, wherein said groove is defined by a radially outward wall and a radially inward wall both extending parallel to the periphery of said dielectric substance.

8. A dielectric coaxial resonator as set forth in claim 1, wherein said groove is defined by a tapered wall.

9. A dielectric coaxial resonator as set forth in claim 8, wherein the tapered wall is so oriented as to narrow the width of said groove in a depth direction.

10. A dielectric coaxial resonator as set forth in claim 1, wherein said groove is defined by a radially outward wall and a radially inward wall, the radially inward wall being so oriented at a given angle to the center line of said dielectric substance as to form a frusto-conical portion around an end portion of said through hole.

11. A dielectric coaxial resonator as set forth in claim 10, wherein said dielectric substance is circular in cross section along the center line thereof.

12. A dielectric coaxial resonator as set forth in claim 10, wherein said dielectric substance is square in cross section along the center line thereof.

13. A dielectric coaxial resonator as set forth in claim 1, wherein said groove is defined by a radially outward wall and a radially inward wall, the radially outward wall extending parallel to the center line of said dielectric substance, the radially inward wall being so oriented at a given angle to the center line as to define a frustum of pyramid at a portion of said dielectric substance around an end portion of said through hole.

14. A dielectric coaxial resonator as set forth in claim 1, wherein said groove is geometrically so oriented around an end portion of said through hole as to exhibit uniform characteristic impedance.

15. A dielectric coaxial resonator comprising:

a dielectric substance having first and second end portions traversing the center line thereof;

a groove formed in the first end portion of said dielectric substance of the resonator and coaxially with the center line of said dielectric substance to define a double walled portion;

a through hole, formed in said dielectric substance of the resonator, said through hole extending through the center line of said dielectric substance;

an outer conductive member provided around a periphery of said dielectric substance; and an inner conductive member provided over said groove and said through hole, wherein said dielectric substance has a preselected length along the center line thereof, said through hole having a given length shorter than the preselected length of said dielectric substance, and said outer conductive member is isolated from said inner conductive member at the first end portion having said groove formed therein.

16. A dielectric coaxial resonator comprising:

a dielectric substance having a preselected length along the center line thereof, said dielectric substance being substantially square in cross section and having first and second end portions opposite each other and separated by the preselected length;

a first groove formed in the first end portion of said dielectric substance so as to be exposed to the outside, said first groove extending around the center line of said dielectric substance and being substantially square in shape;

a second groove formed in the second end portion of said dielectric substance so as to be exposed to the outside, said second groove extending around the center line of said dielectric substance and being substantially square in shape;

a through hole, formed in said dielectric substance, extending through the center line of said dielectric substance, said through hole having a given length shorter than the preselected length of said dielectric substance;

an outer conductive member provided around a periphery of said dielectric substance; and an inner conductive member provided over said first and second grooves and said through hole.

17. A dielectric coaxial resonator as set forth in claim 16, wherein the inner and outer conductive members are isolated from each other at least at one of the end portions of the dielectric substance.

18. A dielectric coaxial resonator comprising:

a dielectric substance having a preselected length along the center line thereof and first and second end portions opposite each other and separated by the preselected length;

a groove formed in the first end portion of said dielectric substance so as to be exposed to the outside, said groove being defined around the center line of said dielectric substance by a radially outward wall and a radially inward wall both extending at given angles to the center line of said dielectric substance so as to form tapered surfaces, respectively;

a through hole, formed in said dielectric substance, extending through the center line of said dielectric substance, said through hole having a given length shorter than the preselected length of said dielectric substance;

an outer conductive member provided around a periphery of said dielectric substance; and an inner conductive member provided over said groove and said through hole.

19. A dielectric coaxial resonator as set forth in claim 18, wherein the inner and outer conductive members are isolated from each other at least at one of the end portions of the dielectric substance.

20. A dielectric coaxial resonator as set forth in claim 18, wherein the tapered surfaces are so oriented as to narrow the width of said groove in a depth direction.

21. A dielectric coaxial resonator as set forth in claim 18, wherein said dielectric substance is substantially square in cross section, said groove extending around the center line of said dielectric substance and being substantially square in shape.

22. A dielectric coaxial resonator comprising:

a dielectric substance being substantially square in cross section and having a preselected length along the center line thereof and having first and second end portions opposite each other and being separated by the preselected length;

a through hole, formed in said dielectric substance, extending through the center line of said dielectric substance, said through hole having a given length shorter than the preselected length of said dielectric substance;

a substantially square groove formed in the fist end portion of said dielectric substance so as to be exposed to the outside, said groove being defined around the center line of said dielectric substance by a radially outward wall and a radially inward wall, the radially outward wall extending parallel to the center line of said dielectric substance, the radially inward wall extending at a given angle to the center line as to define a frustum of pyramid at a portion of said dielectric substance around an end portion of said through hole;

an outer conductive member provided around a periphery of said dielectric substance; and an inner conductive member provided over said groove and said through hole.

23. A dielectric coaxial resonator as set forth in claim 22, wherein each side of the square groove extends parallel to one of sides of said dielectric substance.

24. A dielectric coaxial resonator as set forth in claim 23, wherein corners of said square groove are rounded.

25. A dielectric coaxial resonator as set forth in claim 22, wherein the inner and outer conductive members are isolated from each other by the dielectric substance at least at one of the end portions of the dielectric substance.

* * * * *